US006976547B2

(12) United States Patent
Rial et al.

(10) Patent No.: US 6,976,547 B2
(45) Date of Patent: Dec. 20, 2005

(54) ACTUATOR UNDERREAMER

(75) Inventors: Monty H. Rial, Dallas, TX (US); Joseph A. Zupanick, Pineville, WV (US)

(73) Assignee: CDX Gas, LLC, Dallas, TX (US)

( * ) Notice: Subject to any disclaimer, the term of this patent is extended or adjusted under 35 U.S.C. 154(b) by 254 days.

(21) Appl. No.: 10/196,042

(22) Filed: Jul. 16, 2002

(65) Prior Publication Data

US 2004/0011560 A1 Jan. 22, 2004

(51) Int. Cl.[7] ..... E21B 7/28
(52) U.S. Cl. ..... 175/263; 175/292
(58) Field of Search ..... 125/263, 265, 125/284, 288, 292, 61

(56) References Cited

U.S. PATENT DOCUMENTS

| | | | | |
|---|---|---|---|---|
| 54,144 | A | 4/1866 | Hamar | 175/263 |
| 130,442 | A | 8/1872 | Russell | |
| 274,740 | A | 3/1883 | Douglass | |
| 526,708 | A | 10/1894 | Horton | |

(Continued)

FOREIGN PATENT DOCUMENTS

| | | | |
|---|---|---|---|
| CA | 1067819 | 12/1979 | E21B/43/25 |
| DE | 1 207 907 | 12/1965 | |
| EP | 0 300 627 A1 | 1/1989 | |
| WO | WO 01/83932 A1 | 11/2001 | E21B/7/20 |
| WO | WO 01/83932 A1 | 11/2001 | E21B/7/20 |

OTHER PUBLICATIONS

Nackerud Product Description.

Pend Pat App, Monty H. Rial et al., "*Pantograph Underreamer*," SN 09/929,568 (067083.0145), Filed Aug. 13, 2001.

(Continued)

*Primary Examiner*—William Neuder
(74) *Attorney, Agent, or Firm*—Fish & Richardson P.C.

(57) ABSTRACT

An underreamer for forming a cavity from within a well bore includes a housing adapted to be disposed within the well bore. The underreamer includes an actuator partially slidably positioned in the housing. The actuator comprises a first portion and a second portion. A cross-sectional area of the second portion is larger than a cross-sectional area of the first portion. The underreamer includes at least one cutter set, wherein each cutter set has a first end and a second end. The first end of each cutter set is pivotally coupled to the housing. The second end of each cutter set is pivotally coupled to a connector. An axial force applied to the actuator is operable to slide the actuator relative to the housing causing the second portion of the actuator to contact each cutter set and extend each cutter set radially outward relative to the housing from a retracted position to a first position. The actuator may also include a stop member proximate an end of the actuator. The stop member may be operable to force the connector to slide relative to the housing during the application of the axial force, causing each cutter set to further extend radially outward relative to the housing from the first position to a second position.

23 Claims, 4 Drawing Sheets

U.S. PATENT DOCUMENTS

| | | | | | |
|---|---|---|---|---|---|
| 639,036 | A | | 12/1899 | Heald | 175/263 |
| 1,189,560 | A | | 7/1916 | Gondos | 175/265 |
| 1,230,666 | A | | 6/1917 | Carden | |
| 1,285,347 | A | | 11/1918 | Otto | 175/263 |
| 1,317,192 | A | | 9/1919 | Jones | |
| 1,467,480 | A | | 9/1923 | Hogue | 175/263 |
| 1,485,615 | A | | 3/1924 | Jones | 175/263 |
| 1,498,463 | A | | 6/1924 | McCloskey et al. | |
| 1,589,508 | A | | 6/1926 | Boynton | |
| 1,674,392 | A | | 6/1928 | Flansburg | |
| 1,710,998 | A | | 4/1929 | Rudkin | |
| 1,970,063 | A | | 8/1934 | Steinman | 255/74 |
| 2,018,285 | A | | 10/1935 | Schweitzer et al. | 166/21 |
| 2,031,353 | A | | 2/1936 | Woodruff | 255/76 |
| 2,033,521 | A | | 3/1936 | Horn | |
| 2,069,482 | A | | 2/1937 | Seay | 255/76 |
| 2,150,228 | A | | 3/1939 | Lamb | 166/10 |
| 2,169,502 | A | | 8/1939 | Santiago | 255/76 |
| 2,169,718 | A | | 8/1939 | Böll et al. | 255/24 |
| 2,203,998 | A | | 6/1940 | O'Grady | |
| 2,290,502 | A | | 7/1942 | Squires | 255/76 |
| 2,450,223 | A | | 9/1948 | Barbour | 255/76 |
| 2,490,350 | A | | 12/1949 | Grable | 166/4 |
| 2,662,486 | A | | 12/1953 | Hillger | |
| 2,679,903 | A | | 6/1954 | McGowen, Jr. et al. | 166/1 |
| 2,814,463 | A | | 11/1957 | Kammerer, Jr. | |
| 2,847,189 | A | | 8/1958 | Shook | 255/76 |
| 3,087,552 | A | | 4/1963 | Graham | |
| 3,107,731 | A | | 10/1963 | Dinning | |
| 3,126,065 | A | * | 3/1964 | Chadderdon | |
| 3,196,961 | A | | 7/1965 | Kammerer | |
| 3,236,320 | A | | 2/1966 | Russ | |
| 3,339,647 | A | | 9/1967 | Kammerer, Jr. | 175/268 |
| 3,378,069 | A | | 4/1968 | Fields | |
| 3,379,266 | A | | 4/1968 | Fletcher | 175/285 |
| 3,397,750 | A | | 8/1968 | Wicklund | 175/18 |
| 3,443,648 | A | | 5/1969 | Howard | 175/103 |
| 3,528,516 | A | | 9/1970 | Brown | 175/267 |
| 3,530,675 | A | | 9/1970 | Turzillo | |
| 3,552,509 | A | | 1/1971 | Brown | |
| 3,554,304 | A | | 1/1971 | Link | |
| 3,598,193 | A | | 8/1971 | Hilton | |
| 3,656,564 | A | | 4/1972 | Brown | |
| 3,684,041 | A | | 8/1972 | Kammerer, Jr. et al. | 175/267 |
| 3,731,753 | A | | 5/1973 | Weber | |
| 3,757,876 | A | | 9/1973 | Pereau | 175/267 |
| 3,757,877 | A | | 9/1973 | Leathers | 175/269 |
| 4,073,351 | A | | 2/1978 | Baum | 175/14 |
| 4,083,653 | A | | 4/1978 | Stiffler | |
| 4,116,012 | A | | 9/1978 | Abe et al. | |
| 4,151,880 | A | | 5/1979 | Vann | 166/314 |
| 4,158,388 | A | | 6/1979 | Owen et al. | 166/286 |
| 4,169,510 | A | | 10/1979 | Meigs | 175/65 |
| 4,189,184 | A | | 2/1980 | Green | 299/8 |
| 4,243,099 | A | | 1/1981 | Rodgers, Jr. | 166/65 R |
| 4,278,137 | A | | 7/1981 | Van Eek | 175/267 |
| 4,323,129 | A | | 4/1982 | Cordes | 175/285 |
| 4,366,988 | A | | 1/1983 | Bodine | 299/14 |
| 4,396,076 | A | | 8/1983 | Inoue | 175/265 |
| 4,401,171 | A | | 8/1983 | Fuchs | 175/267 |
| 4,407,376 | A | | 10/1983 | Inoue | 175/267 |
| 4,494,616 | A | | 1/1985 | McKee | 175/67 |
| 4,549,630 | A | | 10/1985 | Brown | 181/106 |
| 4,558,744 | A | | 12/1985 | Gibb | 166/335 |
| 4,565,252 | A | | 1/1986 | Campbell et al. | 175/269 |
| 4,618,009 | A | | 10/1986 | Carter et al. | 175/267 |
| 4,674,579 | A | | 6/1987 | Geller et al. | 175/45 |
| 4,715,440 | A | | 12/1987 | Boxell et al. | 166/100 |
| 4,830,105 | A | | 5/1989 | Petermann | 166/241 |
| 4,887,668 | A | | 12/1989 | Lynde et al. | 166/55.8 |
| 5,009,273 | A | | 4/1991 | Grabinski | |
| 5,036,921 | A | | 8/1991 | Pittard et al. | 166/298 |
| 5,074,366 | A | | 12/1991 | Karlsson et al. | |
| 5,111,893 | A | | 5/1992 | Kvello-Aune | |
| 5,135,058 | A | | 8/1992 | Millgard et al. | 175/71 |
| 5,148,875 | A | | 9/1992 | Karlsson et al. | 175/62 |
| 5,168,942 | A | | 12/1992 | Wydrinski | |
| 5,174,374 | A | | 12/1992 | Hailey | |
| 5,197,553 | A | | 3/1993 | Leturno | 175/57 |
| 5,201,817 | A | | 4/1993 | Hailey | 175/269 |
| 5,242,017 | A | | 9/1993 | Hailey | 166/55.8 |
| 5,255,741 | A | | 10/1993 | Alexander | 166/278 |
| 5,271,472 | A | | 12/1993 | Leturno | 175/107 |
| 5,348,091 | A | | 9/1994 | Tchakarov et al. | 166/217 |
| 5,363,927 | A | | 11/1994 | Frank | 175/67 |
| 5,385,205 | A | | 1/1995 | Hailey | 166/55.8 |
| 5,392,862 | A | | 2/1995 | Swearingen | 166/386 |
| 5,402,856 | A | | 4/1995 | Warren et al. | 175/57 |
| 5,413,183 | A | | 5/1995 | England | 175/53 |
| 5,494,121 | A | | 2/1996 | Nackerud | 175/263 |
| 5,499,687 | A | | 3/1996 | Lee | 175/317 |
| 5,722,489 | A | | 3/1998 | Lambe et al. | 166/269 |
| 5,853,054 | A | | 12/1998 | McGarian et al. | 175/267 |
| 6,070,677 | A | | 6/2000 | Johnston, Jr. | 175/57 |
| 6,082,461 | A | | 7/2000 | Newman et al. | 166/381 |
| 6,142,232 | A | | 11/2000 | Troutt et al. | |
| 6,217,260 | B1 | | 4/2001 | He | 405/237 |
| 6,227,312 | B1 | | 5/2001 | Eppink et al. | 175/57 |
| 6,378,626 | B1 | | 4/2002 | Wallace | 175/19 |
| 6,412,556 | B1 | | 7/2002 | Zupanick | 166/255.2 |
| 6,454,000 | B1 | | 9/2002 | Zupanick | 166/243 |
| 6,454,024 | B1 | | 9/2002 | Nackerud | |
| 6,494,272 | B1 | * | 12/2002 | Eppink et al. | 175/57 |
| 6,533,035 | B2 | | 3/2003 | Troutt et al. | |
| 6,591,922 | B1 | * | 7/2003 | Rial et al. | 175/288 |
| 6,595,302 | B1 | * | 7/2003 | Diamond et al. | 175/65 |
| 6,644,422 | B1 | | 11/2003 | Rial et al. | 175/57 |
| 2002/0070052 | A1 | * | 6/2002 | Armell et al. | 175/273 |
| 2004/0206547 | A1 | * | 10/2004 | de Luca | 175/57 |

OTHER PUBLICATIONS

Pend Pat App, Monty H. Rial et al., "*Pantograph Underreamer*," SN 09/929,551 (067083.0126), Filed Aug. 13, 2001.

Pend Pat App, Monty H. Rial et al., "*Pantograph Underreamer*," SN 09/929,175 (067083.0142), Filed Aug. 13, 2001.

Pend Pat App, Lawrence W. Diamond et al., "*Single–BladeUnderreamer*," SN 09/932,482, (067083.0125) Filed Aug. 17, 2001.

Pend Pat App, Lawrence W. Diamond et al., "*Multi–Blade-Underreamer*," SN 09/932,487 (067083.0136), Filed Aug. 17, 2001.

Pend Pat App, Monty H. Rial et al., "*Pantograph Underreamer*," SN 10/079,444 (067083.0143), Filed Feb. 19, 2002.

Pend Pat App, Joseph A. Zupanick, "*Wedge Activated Underreamer*," SN 10/160,425 (067083.0166), Filed May 31, 2002.

Notification of Transmittal of the International Search Report or the Declaration (PCT Rule 44.1) mailed Nov. 13, 2003 (8 pages) re International Application No. PCT/US 03/21891, Jul. 15, 2003.

Notification of Transmittal of the International Search Report or the Declaration (PCT Rule 44.1) mailed Jul. 4, 2003 (10 pages) re International Application No. PCT/US 03/04771, Jul. 4, 2003.

Notification of Transmittal of the International Search Report or the Declaration (PCT Rule 44.1) mailed Sep. 2, 2003 (8 pages) re International Application No. PCT/US 03/14828, May 12, 2003.
Zupanick et al., U.S . Patent Application entitled, "Cavity Positioning Tool and Method,"S/N 10/188,159 filed Jul. 1, 2003.
Zupanick et al., U.S. Patent Application entitled, "Slot Cavity,"S/N 10/419,529 filed Apr. 21, 2003.
Zupanick et al., U.S. Patent Application entitled, "Cavity Positioning Tool and Method,"S/N10/687,362 filed Oct. 14, 2003.

E–Tronics, ABI Oil Tools, Tubin Rotator Operating Effectivenss, Jun. 2002.

* cited by examiner

ACTUATOR UNDERREAMER

TECHNICAL FIELD OF THE INVENTION

This invention relates in general to the field of subterranean exploration and, more particularly, to an actuator underreamer.

BACKGROUND OF THE INVENTION

Underreamers may be used to form an enlarged cavity in a well bore extending through a subterranean formation. The cavity may then be used to collect resources for transport to the surface, as a sump for the collection of well bore formation cuttings and the like or for other suitable subterranean exploration and resource production operations. Additionally, the cavity may be used in well bore drilling operations to provide an enlarged target for constructing intersecting well bores.

One example of an underreamer includes a plurality of cutting blades pivotally coupled to a lower end of a drill pipe. Centrifugal forces caused by rotations of the drill pipe extends the cutting blades outwardly and diametrically opposed to each other. As the cutting blades extend outwardly, the centrifugal forces cause the cutting blades to contact the surrounding formation and cut through the formation. The drill pipe may be rotated until the cutting blades are disposed in a position substantially perpendicular to the drill pipe, at which time the drill pipe may be raised and/or lowered within the formation to form a cylindrical cavity within the formation.

Conventional underreamers, however, suffer several disadvantages. For example, the underreamer described above generally requires high rotational speeds to produce an adequate level of centrifugal force to cause the cutting blades to cut into the formation. An equipment failure occurring during high speed rotation of the above-described underreamer may cause serious harm to operators of the underreamer as well as damage and/or destruction of additional drilling equipment.

Additionally, density variations in the subsurface formation may cause each of the cutting blades to extend outwardly at different rates and/or different positions relative to the drill pipe. The varied positions of the cutting blades relative to the drill pipe may cause an out-of-balance condition of the underreamer, thereby creating undesired vibration and rotational characteristics during cavity formation, as well as an increased likelihood of equipment failure.

SUMMARY OF THE INVENTION

The present invention provides an actuator underreamer that substantially eliminates or reduces at least some of the disadvantages and problems associated with previous underreaming tools.

In accordance with a particular embodiment of the present invention, an underreamer for forming a cavity from within a well bore includes a housing adapted to be disposed within the well bore. The underreamer includes an actuator partially slidably positioned in the housing. The actuator comprises a first portion and a second portion. A cross-sectional area of the second portion is larger than a cross-sectional area of the first portion. The underreamer includes at least one cutter set, wherein each cutter set has a first end and a second end. The first end of each cutter set is pivotally coupled to the housing. The second end of each cutter set is pivotally coupled to a connector. An axial force applied to the actuator is operable to slide the actuator relative to the housing causing the second portion of the actuator to contact each cutter set and extend each cutter set radially outward relative to the housing from a retracted position to a first position.

The actuator may also include a stop member proximate an end of the actuator. The stop member may be operable to force the connector to slide relative to the housing during the application of the axial force, causing each cutter set to further extend radially outward relative to the housing from the first position to a second position.

In accordance with another embodiment, a method for forming a cavity within a well bore includes providing an underreamer within the well bore wherein the underreamer has a housing and an actuator. The actuator includes a first portion and a second portion. A cross-sectional area of the second portion is larger than a cross-sectional area of the first portion. The actuator is partially slidably positioned in the housing. The underreamer has at least one cutter set. Each cutter set has a first end and a second end. The first end of each cutter set is pivotally coupled to the housing. The second end of each cutter set is pivotally coupled to a connector. The method includes applying an axial force to the actuator, causing the actuator to slide relative to the housing and causing the second portion of the actuator to contact each cutter set. The method also includes extending each cutter set radially outward relative to the housing from a retracted position to a first position to form the cavity. The extension is in response to the contact of each cutter set by the second portion and movement of the actuator from the applied axial force.

The method may also include further extending each cutter set radially outward relative to the housing from the first position to a second position to form the cavity. The further extension is in response to a stop member of the actuator forcing the connector to slide relative to the housing. The stop member is proximate an end of the actuator.

Particular embodiments of the present invention may include one or more of the following technical advantages. Some embodiments include an underreamer in which an axial force is applied to an actuator having a second portion with a cross-sectional area larger than the cross-sectional area of a first portion such that the second portion contacts and extends cutter sets of the underreamer as the actuator moves relative to the housing. Accordingly, little or no rotation of the housing may be required to extend the cutter sets, thereby substantially reducing or eliminating hazards associated with high speed rotating mechanisms.

Particular embodiments of the present invention substantially reduce or eliminate out-of-balance conditions resulting from extension of cutter sets within a well bore. For example, according to certain embodiments of the present invention, a second portion of an actuator forces each cutter set radially outward relative to the underreamer housing as the second portion moves relative to the housing, thereby resulting in substantially uniform extension of each cutter set relative to the housing. Accordingly, occurrences of out-of-balance conditions caused by varying positions of cutter sets are substantially reduced or eliminated.

Other technical advantages will be readily apparent to one skilled in the art from the figures, descriptions and claims included herein. Moreover, while specific advantages have been enumerated above, various embodiments may include all, some or none of the enumerated advantages.

BRIEF DESCRIPTION OF THE DRAWINGS

For a more complete understanding of particular embodiments of the invention and their advantages, reference is now made to the following descriptions, taken in conjunction with the accompanying drawings, in which.

DETAILED DESCRIPTION OF THE INVENTION

Figure 1:
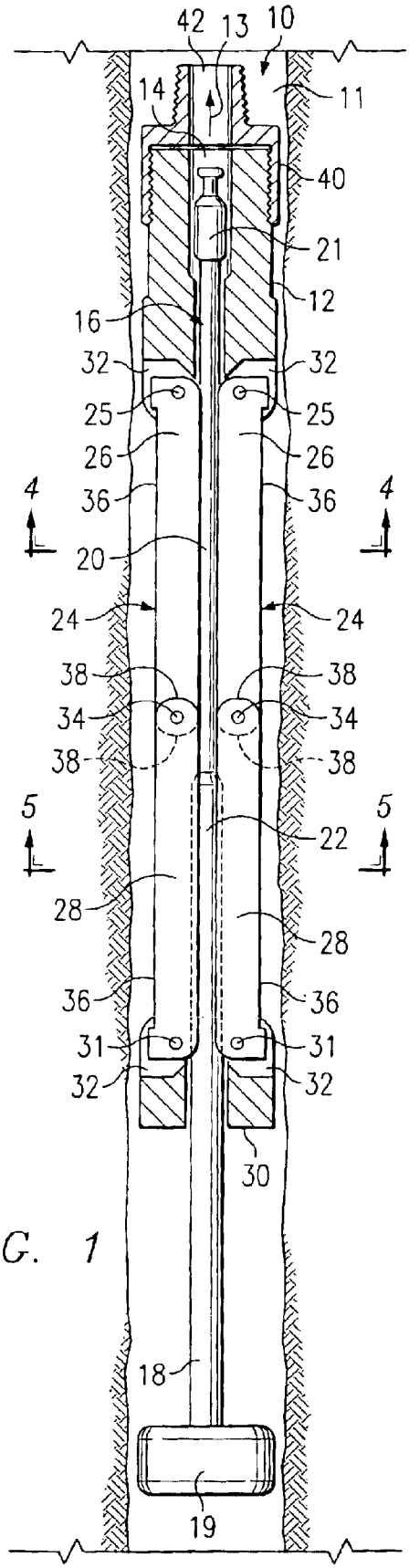
FIG. 1 is a diagram illustrating an underreamer in accordance with an embodiment of the present invention.

FIG. 1 illustrates an underreamer 10 in accordance with an embodiment of the present invention. Underreamer 10 includes a housing 12 illustrated as being substantially vertically disposed within a well bore 11. However, it should be understood that underreamer 10 may also be used in non-vertical cavity forming operations.

Underreamer 10 includes an actuator 16 with a portion slidably positioned within an internal passage 14 of housing 12. Actuator 16 includes an actuation rod 18 and a stop member 19. Actuation rod 18 includes a first portion 20 and a second portion 22. Second portion 22 of actuation rod 18 has a cross-sectional area larger than first portion 20, as discussed below with respect to FIGS. 4 and 5. Actuator 16 also includes a fishing neck 21 coupled to an end of actuation rod 18.

Underreamer 10 also includes cutter sets 24 pivotally coupled to housing 12. In this embodiment, cutter sets 24 are pivotally coupled to housing 12 via pins 25; however, other suitable methods may be used to provide pivotal or rotational movement of cutter sets 24 relative to housing 12. Cutter sets 24 are also pivotally coupled to a connector 30. In the illustrated embodiment, cutter sets 24 are pivotally coupled to connector 30 via pins 31; however, other suitable methods may be used to provide pivotal or rotational movement of cutter sets 24 relative to connector 30. Actuation rod 18 is slidably positioned through an internal passage of connector 30. Although connector 30 is illustrated as a separate component coupled to each cutter set 34, in particular embodiments the connector may be a component that couples cutter sets 34 together, such as a pin.

Cutter sets 24 are illustrated in a retracted position, nesting around actuation rod 18. The illustrated embodiment shows underreamer 10 having two cutter sets 24; however, other embodiments may include an underreamer having one or more than two cutter sets 24.

Each cutter set 24 includes a first cutter 26 and a second cutter 28. Each first cutter 26 is pivotally coupled to a respective second cutter 28. In the illustrated embodiment, each first cutter 26 is pivotally coupled to a second cutter 28 via a pin 34; however, other suitable methods may be used to provide pivotal or rotational movement of first and second cutters 26 and 28 relative to one another. In particular embodiments, first and second cutters 26 and 28 may have a length of approximately two to four feet; however, the length of first and second cutters 26 and 28 may be any appropriate length.

The locations on each first cutter 26 and second cutter 28 where cutters 26 and 28 are coupled may be at a point that is not at the ends of first cutter 26 and/or second cutter 28. Coupling first and second cutters 26 and 28 at a location other than their ends can shield and protect pins 34 during operation of underreamer 10 since pins 34 may not be in contact with exposed surfaces of well bore 11 during operation.

In the illustrated embodiment, housing 12 and connector 30 include outwardly facing recesses 32 which are each adapted to receive at least one of first and second cutters 26 and 28. Housing 12 and connector 30 may have bevels or "stops" at each recess 32 in order to limit the rotational movement of first and second cutters 26 and 28 when the cutters are extended. Other methods may also be used to prevent first and second cutters 26 and 28 from rotating past a particular position.

In the embodiment illustrated in FIG. 1, first and second cutters 26 and 28 include side cutting surfaces 36 and end cutting surfaces 38. First and second cutters 26 and 28 may also include tips which may be replaceable in particular embodiments as the tips get worn down during operation. In such cases, the tips may include end cutting surfaces 38. Cutting surfaces 36 and 38 and the tips may be dressed with a variety of different cutting materials, including, but not limited to, polycrystalline diamonds, tungsten carbide inserts, crushed tungsten carbide, hard facing with tube barium, or other suitable cutting structures and materials, to accommodate a particular subsurface formation. Additionally, various cutting surfaces 36 and 38 configurations may be machined or formed on first and second cutters 26 and 28 to enhance the cutting characteristics of first and second cutters 26 and 28.

Housing 12 is threadably coupled to a drill pipe connector 40 in this embodiment; however other suitable methods may be used to couple drill pipe connector 40 to housing 12. Drill pipe connector 40 may be coupled to a drill string that leads up well bore 11 to the surface. Drill pipe connector 40 includes a passage 42 with an end which opens into internal passage 14 of housing 12.

In operation fishing neck 21 is configured to engage a fishing tool lowered within well bore 11 through passage 42 of drill pipe connector 40 and internal passage 14 of housing 12. An axial force is applied to the fishing tool which in turn exerts an axial force on actuator 16, including actuation rod 18, causing actuation rod 18 to slide relative to housing 12 and connector 30. The axial force is a force in a direction along the longitudinal axis of actuation rod 18. Such direction is illustrated by arrow 13. The fishing tool can be a 1½" jar down to shear tool; however, other suitable techniques may be used to exert an axial force on actuation rod 18 to slide actuation rod 18 relative to housing 12 and connector 30.

The movement of actuation rod 18 causes second portion 22 to come into contact with cutter sets 24. Second portion 22 forces cutter sets 24 to rotate about pins 25 and pins 31 and extend radially outward relative to housing 12 as second portion 22 moves relative to housing 12. More specifically, in the illustrated embodiment, second portion 22 contacts first cutters 26 and wedges first cutters 26 open. Second portion 22 forces first cutters 26 to rotate about pins 25 and extend radially outward relative to housing 12 as second portion 22 moves relative to housing 12. As first cutters 26 extend radially outward, second cutters 28 rotate about pins 31 and extend radially outward as well.

It should be understood that in particular embodiments, second portion 22 may contact second cutters 28 and wedge second cutters 26 open. Second portion 22 may then force first cutters 26 and second cutters 28 to extend radially outward relative to housing 12. Thus, the wedging open of cutter sets 24 may be initiated on either first cutters 26 or second cutters 28, and the cross-sections of first cutters 26 and second cutters 28 may be configured to allow such wedging of either first cutters 26 or second cutters 28.

Through the extension of cutter sets 24 via the movement of actuation rod 18 and second portion 22 relative to housing 12, underreamer 10 forms an enlarged cavity as cutting surfaces 36 and 38 come into contact with the surfaces of well bore 11.

Housing 12 may be rotated within well bore 11 as cutter sets 24 extend radially outward to aid in forming the cavity. Rotation of housing 12 may be achieved using a drill string coupled to drill pipe connector 40; however, other suitable methods of rotating housing 12 may be utilized. For example, a downhole motor in well bore 11 may be used to rotate housing 12. In particular embodiments, both a downhole motor and a drill string may be used to rotate housing 12. The drill string may also aid in stabilizing housing 12 in well bore 11.

Figure 2:
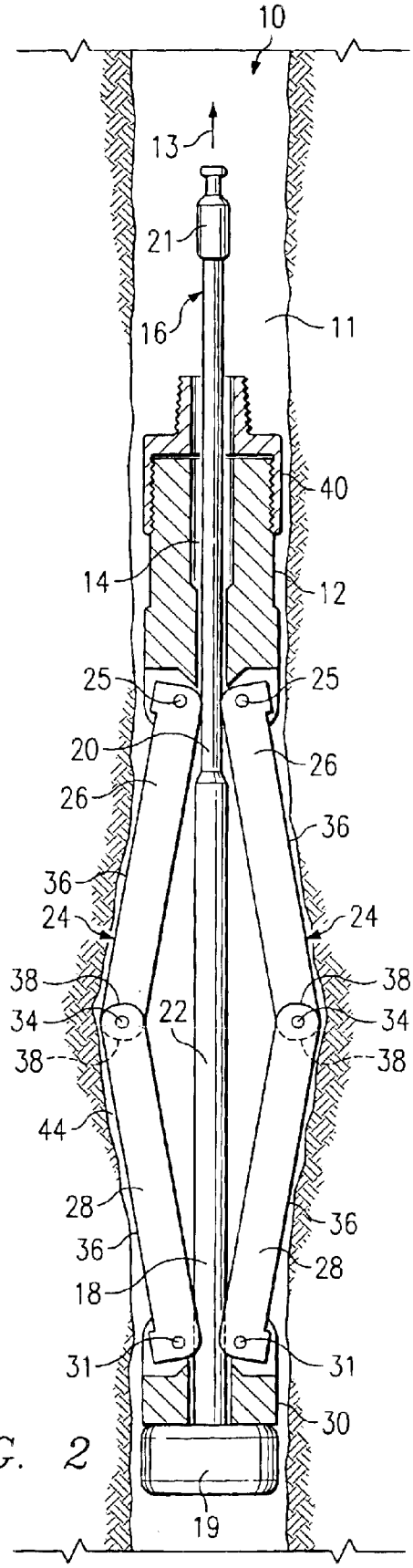
FIG. 2 is a diagram illustrating the underreamer of FIG. 1 in a semi-extended position.

FIG. 2 is a diagram illustrating underreamer 10 of FIG. 1 in a semi-extended position. In FIG. 2, cutter sets 24 are in a semi-extended position relative to housing 12 and have begun to form an enlarged cavity 44. When the axial force is applied and actuation rod 18 moves relative to housing 12, stop member 19 of actuator 16 also moves relative to housing 12 and eventually reaches and contacts connector 30. At this point, cutter sets 24 are extended as illustrated as a result of second portion 22 of actuation rod 18 forcing the extension. In other embodiments, cutter sets 24 may be extended to a lesser or further extent when stop member 19 reaches and contacts connector 30.

Figure 3:
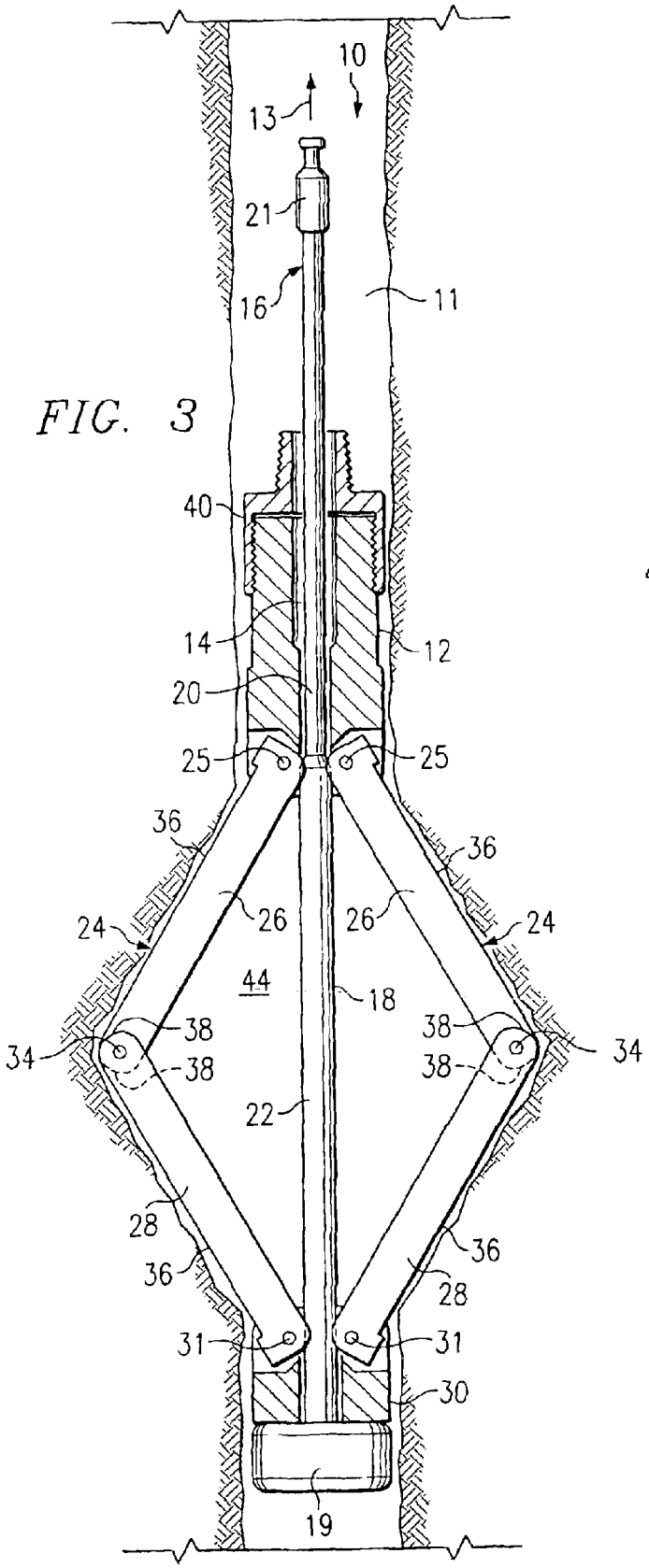
FIG. 3 is a diagram illustrating the underreamer of FIG. 1 in an extended position.

FIG. 3 is a diagram illustrating underreamer 10 of FIG. 1 in an extended position. Once enough axial force has been exerted on actuation rod 18 such that stop member 19 slides enough to contact connector 30 thereby extending cutter sets 24 to a semi-extended position as illustrated in FIG. 2, the continued application of the axial force to actuator 16 causes stop member 18 to force connector 30 to slide with actuation rod 18 relative to housing 12. This occurs because the drill string coupled to drill pipe connector 40 exerts a stabilizing force on housing 12. Thus, the continued application of the axial force on actuator 16 causes connector 30 to slide with actuation rod 18 relative to housing 12, forcing cutter sets 24 to further rotate about pins 25 and 31 and further extend radially outward relative to housing 12. Cutter sets 24 may be extended as illustrated in FIG. 3. As stated above, housing 12 and connector 30 may include bevels or "stops" of recesses 32 in order to restrict the rotation and extension of cutter sets 24 passed particular points. Other methods may also be used in order to restrict such rotation and extension. In particular embodiments where the connector is a component that couples cutter sets 24 together, the further extension of cutter sets 24 may be caused by the stop member contacting either the connector or the ends of the cutter sets and forcing the connector and the ends of the cutter sets to slide relative to the housing.

Underreamer 10 may be raised and lowered within well bore 11 to further define and shape cavity 44. Such movement may be accomplished by raising and lowering the drill string coupled to drill pipe connector 40. Housing 12 may also be rotated to further define and shape cavity 44. It should be understood that a subterranean cavity having a shape other than the shape of cavity 44 may be formed with underreamer 10.

Figure 4:
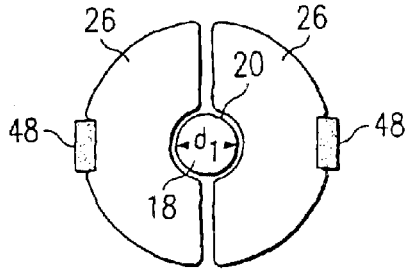
FIG. 4 is a cross-sectional view of FIG. 1 taken along line 4—4, illustrating a first portion of an actuation rod and first cutters of the underreamer of FIG. 1.

FIG. 4 is a cross-sectional view of FIG. 1 taken along line 4—4, illustrating the nesting of first cutters 26 around actuation rod 18 while first cutters 26 are in a retracted position, as illustrated in FIG. 1. The cross-section illustrated of actuation rod 18 is part of first portion 20 of FIG. 1. Actuation rod 18 has a diameter $d_1$ at this portion. First cutters 26 may include cutouts which may be filled with various cutting materials such as a carbide matrix 48 as illustrated to enhance cutting performance. It should be understood that nesting configurations other than the configuration illustrated in FIG. 4 may be used. Furthermore, first cutters 26 may have various other cross-sectional configurations other than the configurations illustrated, and such cross-sectional configurations may differ at different locations on first cutters 26. For example, in particular embodiments, first cutters 26 may not be nested around actuation rod 18.

Figure 5:
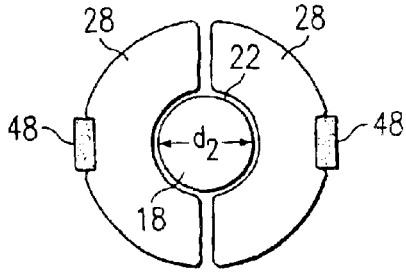
FIG. 5 is a cross-sectional view of FIG. 1 taken along line 5—5, illustrating a second portion of an actuation rod and second cutters of the underreamer of FIG. 1.

FIG. 5 is a cross-sectional view of FIG. 1 taken along line 5—5, illustrating the nesting of second cutters 28 around actuation rod 18 while second cutters 28 are in a retracted position, as illustrated in FIG. 1. The cross-section illustrated of actuation rod 18 in FIG. 5 is part of second portion 22 of FIG. 1. Actuation rod 18 has a diameter $d_2$ at this portion $d_2$ is larger than $d_1$ of FIG. 4, and thus, the cross-sectional area of second portion 22 of actuation rod 18 of FIG. 1 is larger than the cross-sectional area of first portion 20 of actuation rod 18 of FIG. 1. Second cutters 28 may include cutouts which may be filled with various cutting materials such as a carbide matrix 48 as discussed above with respect to first cutters 26 of FIG. 4. It should be understood that nesting configurations other than the configuration illustrated in FIG. 5 may be used. Furthermore, second cutters 28 may have various other cross-sectional configurations other than the configurations illustrated, and such cross-sectional configurations may differ at different locations on second cutters 28. For example, in particular embodiments, second cutters 28 may not be nested around actuation rod 18.

Figure 6:
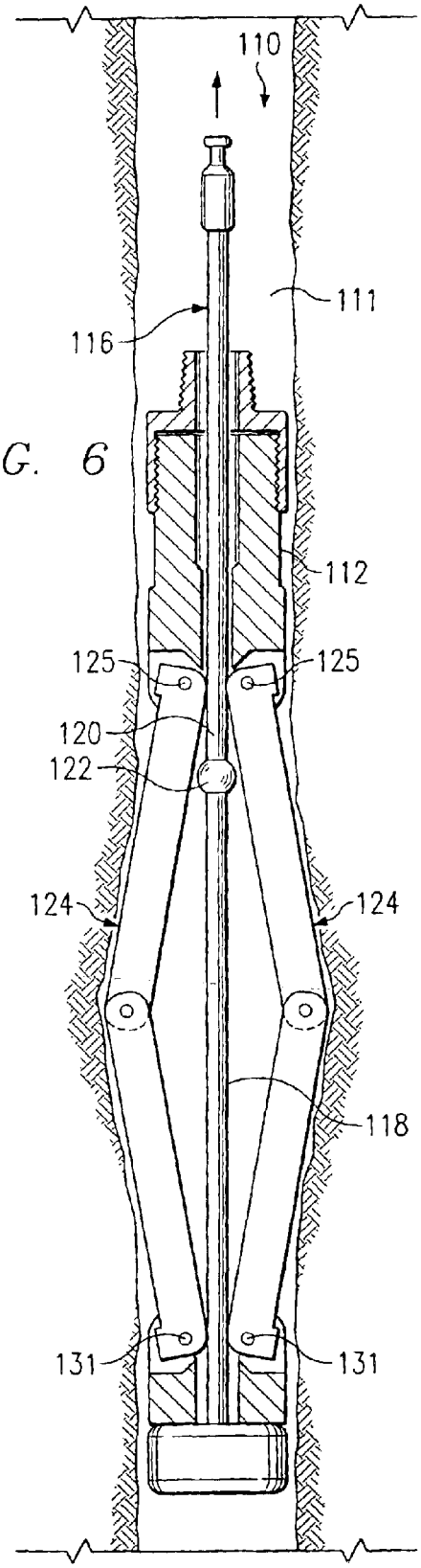
FIG. 6 is a diagram illustrating an underreamer having an actuation rod with a spherically-shaped portion in accordance with another embodiment of the present invention.

FIG. 6 illustrates an underreamer 110 in accordance with another embodiment of the present invention. Underreamer 110 is similar to underreamer 10 illustrated in FIGS. 1–5. However, underreamer 110 includes an actuation rod 118 with a different configuration than actuation rod 18 of underreamer 10. Actuation rod 118 includes a first portion 120 and a second portion 122. Second portion 122 is a spherically-shaped portion of actuation rod 118. As illustrated, second portion 122 has a cross-sectional area larger than first portion 120 of actuation rod 118.

Underreamer 110 operates in a similar manner as underreamer 10 of FIGS. 1–5. For example, when an axial force is applied to actuator 116, actuation rod 118 slides relative to housing 112, and second portion 122 of actuation rod 118 contacts cutter sets 124 and wedges cutter sets 124 open, forcing cutter sets 124 to rotate about pins 125 and 131 and extend radially outward relative to housing 112. Underreamer 110 operates like underreamer 10 in other aspects as well, such as the manner in which cutter sets 124 may be further extended and the manner in which underreamer 110 is used to form an enlarged cavity within well bore 111.

It should be understood that underreamers in accordance with other embodiments of the present invention may include an actuator with an actuation rod having first and second portions with different configurations than those illustrated. For example, a second portion may comprise a cubical, conical or teardrop shape. Other configurations may be used as well so that a cross-sectional area of the second portion of the actuation rod is larger than a cross-sectional area of the first portion of the actuation rod such that the second portion will be operable to contact and extend the cutter sets radially outward relative to the housing of the underreamer when an axial force is applied.

Figure 7:
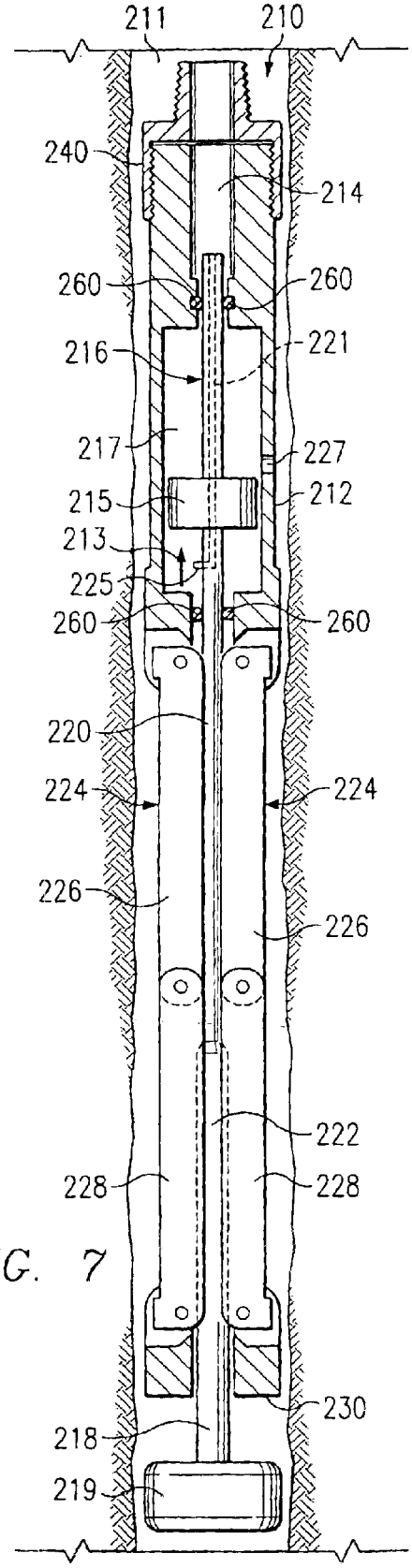
FIG. 7 is a diagram illustrating an underreamer actuated by a pressurized fluid in accordance with another embodiment of the present invention.

FIG. 7 illustrates an underreamer 210 in accordance with another embodiment of the present invention. Underreamer 210 is similar to underreamer 10 illustrated in FIGS. 1–5. However, underreamer 210 includes an actuator 216 which is partially slidably positioned within a pressure cavity 217 of housing 212. Actuator 216 includes an enlarged portion 215, an actuation rod 218, and a stop member 219. Actuation rod 218 includes a first portion 220 with a smaller cross-sectional area than a second portion 222 of the actuation rod.

Actuator 216 includes a fluid passage 221. Fluid passage 221 includes an outlet 225 which allows fluid to exit fluid passage 221 into pressure cavity 217 of housing 212. Pressure cavity 217 includes an exit port 227 which allows fluid to exit pressure cavity 217 into well bore 211. In particular embodiments, exit port 227 may be coupled to a vent hose in order to transport fluid exiting through exit port 227 to the surface or to another location. Seals 260 or packing prevent pressurized fluid from leaking out of pressure cavity 217 around actuator 216.

In operation, a pressurized fluid is passed through an internal passage 214 of housing 212 to fluid passage 221 of actuator 216. Such disposition may occur through a drill pipe connector 240 connected to housing 212. The pressurized fluid flows through fluid passage 221 and exits the fluid passage through outlet 225 into pressure cavity 217. Inside pressure cavity 217, the pressurized fluid exerts an axial force upon enlarged portion 215 of actuator 216. Such axial force is in the general direction of arrow 213. In particular embodiments, the axial force may be applied upon enlarged portion 215 by providing a pressurized fluid into pressure cavity 217 without the fluid passing through a fluid passage of the actuator. The exertion of the axial force on enlarged portion 215 of actuator 216 causes movement of actuator 216 relative to housing 212. Such movement causes second portion 222 of actuation rod 218 to come into contact with cutter sets 224 and wedge open cutter sets 224, extending cutter sets 224 in a similar manner to underreamer 10 of FIGS. 1–3. While a certain amount of movement of enlarged portion 215 within pressure cavity 217 is possible in the illustrated embodiment, it should be understood that other embodiments may allow more or less movement of the enlarged portion within the pressure cavity of the housing. First and second cutters 226 and 228 may be further extended when stop member 219 of actuator 216 reaches and contacts a connector 230, as described above with respect to underreamer 10.

As can be seen from the descriptions above, various techniques may be used to actuate the cutters of the disclosed underreamers, such as a fishing tool and a pressurized fluid. Other embodiments may utilize other techniques to actuate cutters of an underreamer in accordance with an embodiment of the present invention.

Figure 8:
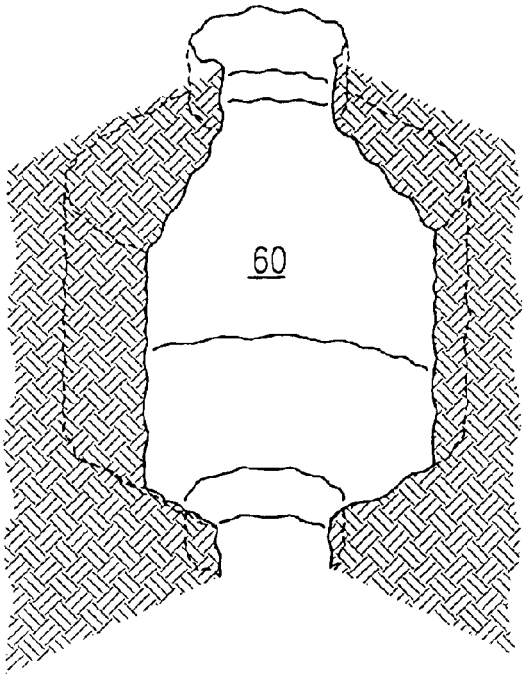
FIG. 8 is an isometric diagram illustrating a generally cylindrical cavity formed using an underreamer in accordance with an embodiment of the present invention.

FIG. 8 is an isometric diagram illustrating a cylindrical cavity 60 formed using an underreamer in accordance with an embodiment of the present invention. Cylindrical cavity 60 has a generally cylindrical shape and may be formed by raising and/or lowering the underreamer in the well bore and by rotating the underreamer.

Figure 9:
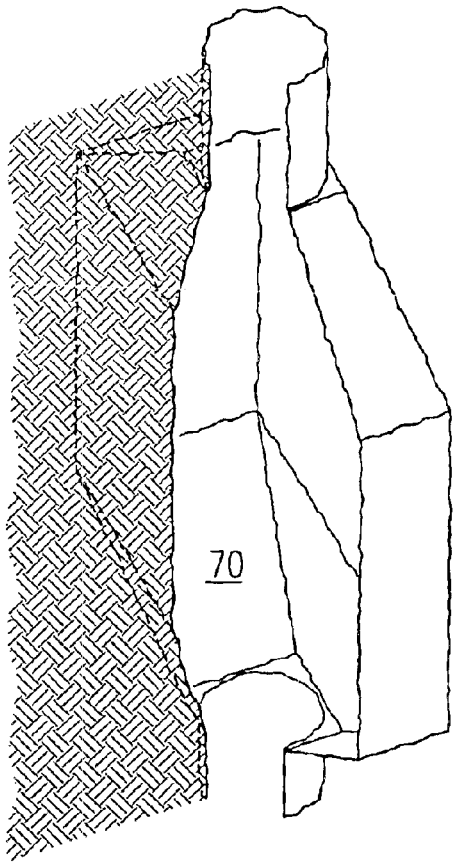
FIG. 9 is an isometric diagram illustrating a slot cavity formed using an underreamer in accordance with an embodiment of the present invention.

FIG. 9 is an isometric diagram illustrating a slot cavity 70 formed using an underreamer in accordance with an embodiment of the present invention. Slot cavity 70 may be formed by raising and/or lowering the underreamer in the well bore. Slot cavity 70 may be formed without rotating the underreamer. Slot cavity 70 has a generally rectangular prism shape with a sizeable cross-sectional area. Such an enlarged cross-sectional area may be advantageous when attempting to intersect slot cavity 70 while drilling another well bore, or may be otherwise advantageous. Slot cavity 70 may also be used for production of fluids, such as hydrocarbons, from fractures or reservoirs of a subterranean zone where the fractures have an orientation approximately perpendicular to the plane of the slot cavity.

Although the present invention has been described in detail, various changes and modifications may be suggested to one skilled in the art. It is intended that the present invention encompass such changes and modifications as falling within the scope of the appended claims.

What is claimed is:

1. An underreamer for forming a cavity from within a well bore, comprising:

a housing adapted to be disposed within the well bore;

an actuator partially slidably positioned in the housing, the actuator comprising a first portion, a second portion, and a stop member proximate an end of the actuator;

wherein a cross-sectional area of the second portion is larger than a cross-sectional area of the first portion;

at least one cutter set, each cutter set having a first end and a second end, the first end of each cutter set pivotally coupled to the housing, the second end of each cutter set pivotally coupled to a connector;

wherein an axial force applied to the actuator is operable to slide the actuator relative to the housing causing the second portion of the actuator to contact each cutter set and extend each cutter set radially outward relative to the housing from a retracted position to a first position; and wherein the stop member is operable to contact the connector as the actuator slides relative to the housing to force the connector to slide relative to the housing during the application of the axial force, causing each cutter set to further extend radially outward relative to the housing from the first position to a second position.

2. The underreamer of claim 1, wherein the actuator comprises an actuation rod, and the actuation rod comprises the first and second portions of the actuator.

3. The underreamer of claim 1, wherein the actuator comprises a fishing neck, the fishing neck adapted to engage a fishing tool disposed within the well bare, the fishing tool operable to apply the axial force to the actuator.

4. The underreamer of claim 1, wherein the actuator comprises an enlarged portion slidably positioned in a pressure cavity of the housing, and wherein the axial force comprises hydraulic pressure applied to the enlarged portion using a pressurized fluid.

5. The underreamer of claim 1, wherein the formed cavity comprises a generally cylindrical shape defined when the underreamer is rotated.

6. The underreamer of claim 1, wherein the formed cavity comprises a generally rectangular prism.

7. The underreamer of claim 1, wherein each cutter set comprises:

a first cutter having a first end and a second end, the first end of the first cutter coupled to the housing;

a second cutter having a first end and a second end, the first end of the second cutter coupled to the connector; and wherein the first cutter and the second cutter are pivotally coupled together.

8. The underreamer of claim 7, wherein the second ends of the first and second cutters extend radially outward relative to the housing when the axial force is applied to the actuator.

9. The underreamer of claim 7, wherein at least one of the first and second comprises a replaceable tip at its second end.

10. A method for forming a cavity within a well bore, comprising:

providing an underreamer within the well bore, the underreamer having a housing and an actuator, the actuator having a first portion and a second portion and a stop member proximate an end of the actuator, wherein a cross-sectional area of the second portion is larger than a cross-sectional area of the first portion, wherein the actuator is partially slidably positioned in the housing, the underreamer further having at least one cutter set, each cutter set having a first end and a second end, the first end of each cutter set pivotally coupled to the housing, the second end of each cutter set pivotally coupled to a connector;

applying an axial force to the actuator, causing the actuator to slide relative to the housing and causing the second portion of the actuator to contact each cutter set;

extending each cutter set radially outward relative to the housing from a retracted position to a first position to form the cavity, wherein the extension is in response to movement of the actuator relative to the housing which causes the second portion of the actuator to contact each cutter set to further extend radially outward relative to the housing from the first position to a second position and which causes the stop member to contact the connector as the actuator slides relative to the housing to force the connector to slide relative to the housing during the application of the axial force.

11. The method of claim 10, further comprising rotating the housing within the well bore to form the cavity.

12. The method of claim 11, wherein the formed cavity comprises a generally cylindrical shape.

13. The method of claim 10, wherein the actuator comprises an actuation rod, and the actuation rod comprises the first and second portions of the actuator.

14. The method of claim 10, further comprising extending a fishing tool into the well bore to engage a fishing neck of the actuator, and wherein applying the axial force comprises applying the axial force to the fishing neck via the fishing tool.

15. The method of claim 10, the actuator comprises an enlarged portion slidably positioned in a pressure cavity of the housing, and wherein the axial force comprises hydraulic pressure applied to the enlarged portion using a pressurized fluid.

16. The method of claim 10, wherein the formed cavity comprises a generally rectangular prism.

17. The method of claim 10, wherein:

each cutter set comprises a first cutter and a second cutter pivotally coupled to the first cutter, the first cutter having a first end and a second end, the first end of the first cutter coupled to the housing, the second cutter having a first end and a second end, the first end of the second cutter coupled to the connector, wherein the first cutter and the second cutter are pivotally coupled together; and extending each cutter set radially outward comprises extending the second ends of each first and second cutter radially outward.

18. The method of claim 17, wherein at least one of the first and second cutters comprises a replaceable tip at its second end.

19. An underreamer for forming a cavity from within a well bore, comprising:

a housing adapted to be disposed within the well bore;

an actuator partially slidably positioned in the housing, the actuator comprising a first portion, a second portion, and a stop member proximate an end of the actuator;

wherein a cross-sectional area of the second portion is larger than a cross-sectional area of the first portion;

at least one first cutter, each first cutter having a first end and a second end, the first end of each first cutter pivotally coupled to the housing;

at least one second cutter, each second cutter pivotally coupled to a respective first cutter, each second cutter having a first end and a second end, the first end of each second cutter pivotally coupled to a connector;

wherein an axial force applied to the actuator is operable to slide the actuator relative to the housing causing the second portion of the actuator to contact each first cutter and extend each first cutter radially outward relative to the housing from a retracted position to a first position; and wherein the stop member is operable to contact the connector as the actuator slides relative to the housing to force the connector to slide relative to the housing during the application of the axial force, causing each cutter set to further extend radially outward relative to the housing from the first position to a second position.

20. The underreamer of claim 19, wherein the actuator comprises an actuation rod, and the actuation rod comprises the first and second portions of the actuator.

21. The underreamer of claim 19, wherein at least one of the first and second cutters comprises a replaceable tip at its second end, the replaceable tip extending past a point at which the first and second cutters are coupled.

22. The underreamer of claim 19, wherein each second cutter is pivotally coupled to a respective first cutter at the second end of the first cutter.

23. The underreamer of claim 19, wherein the underreamer comprises a longitudinal axis, and wherein the first ends of the first and second cutters are disposed substantially along the longitudinal axis.

* * * * *

UNITED STATES PATENT AND TRADEMARK OFFICE

CERTIFICATE OF CORRECTION

PATENT NO. : 6,976,547 B2 
DATED : December 20, 2005
INVENTOR(S) : Monty H. Rial and Joseph A. Zupanick It is certified that error appears in the above-identified patent and that said Letters Patent is hereby corrected as shown below:

Column 8,
Line 58, replace “bare” with -- bore --.

Column 9,
Line 17, after “second” insert -- cutters --.

Signed and Sealed this

Seventh Day of March, 2006

JON W. DUDAS
*Director of the United States Patent and Trademark Office*